US005083102A

United States Patent [19]

Zaki

[11] Patent Number: 5,083,102

[45] Date of Patent: Jan. 21, 1992

[54] DUAL MODE DIELECTRIC RESONATOR FILTERS WITHOUT IRIS

[75] Inventor: Kawthar A. Zaki, Potomac, Md.

[73] Assignee: University of Maryland, College Park, Md.

[21] Appl. No.: 403,165

[22] Filed: Sep. 5, 1989

Related U.S. Application Data

[63] Continuation-in-part of Ser. No. 199,180, May 26, 1988, abandoned.

[51] Int. Cl.[5] ..... H01P 1/20; H01P 1/208

[52] U.S. Cl. ..... 333/212; 333/202; 333/209

[58] Field of Search ..... 333/201, 219, 219.1, 333/208-212, 235

[56] References Cited

U.S. PATENT DOCUMENTS

| | | | |
|---|---|---|---|
| 4,489,293 | 12/1984 | Fiedziuszko | 333/202 |
| 4,571,563 | 2/1986 | Cameron | 333/209 X |
| 4,760,361 | 7/1988 | Kobayashi | 333/209 |

OTHER PUBLICATIONS

Zaki et al., "Coupling Between Hybrid Mode Dielectric Resonators," 1987 IEEE MTT-s Digest, pp. 617-620, Jun. 1987.

Zaki et al., "Coupling of Non-Axially Symmetric Hybrid Modes in Dielectric Resonators", IEEE Trans Microwave The & Tech. vol. MTT-35, No. 12, Dec. 1987, pp. 1136-1141.

Zaki et al., "Dual Mode . . . Without Iris", 1987 IEEE MTT-S Digest, pp. 141-144, Jun. 1987.

Zaki et al., "Canonical . . . Without Iris", IEEE Trans. on Microwave Theory and Tech., vol. MTT-35, No. 12, Dec. 1987, pp. 1130-1135.

Zaki et al., "A New Realization . . . Filters", The 17th European Microwave Conference, Rome, Italy, pp. 169-174, Sep. 1987.

Zaki et al., "Improved Selectivity . . . Filters", SBMO International Microwave Symposium Proceedings, Brazil, pp. 627-632, Jul. 1987.

*Primary Examiner*—Eugene R. LaRoche
*Assistant Examiner*—Seung Ham
*Attorney, Agent, or Firm*—Oblon, Spivak, McClelland, Maier Neustadt

[57] ABSTRACT

A microwave band pass filter including dual-mode dielectric resonators mounted in a tubular enclosure to achieve coupling among the resonators without an iris. The filter is implemented in a canonical symmetric form, as longitudinal dual-mode realization or a canonical asymmetric form. The microwave band pass filter has input and output coaxial probes located along the enclosure with tuning and coupling screws provided to enable adjustment control of the frequency of resonance of the dielectric resonators and to control the coupling of energy from one resonant mode to an orthogonal mode in the same resonator. Lastly, the coupling of energy from one resonator to an adjacent resonator is accomplished by properly placed coupling screws.

12 Claims, 8 Drawing Sheets

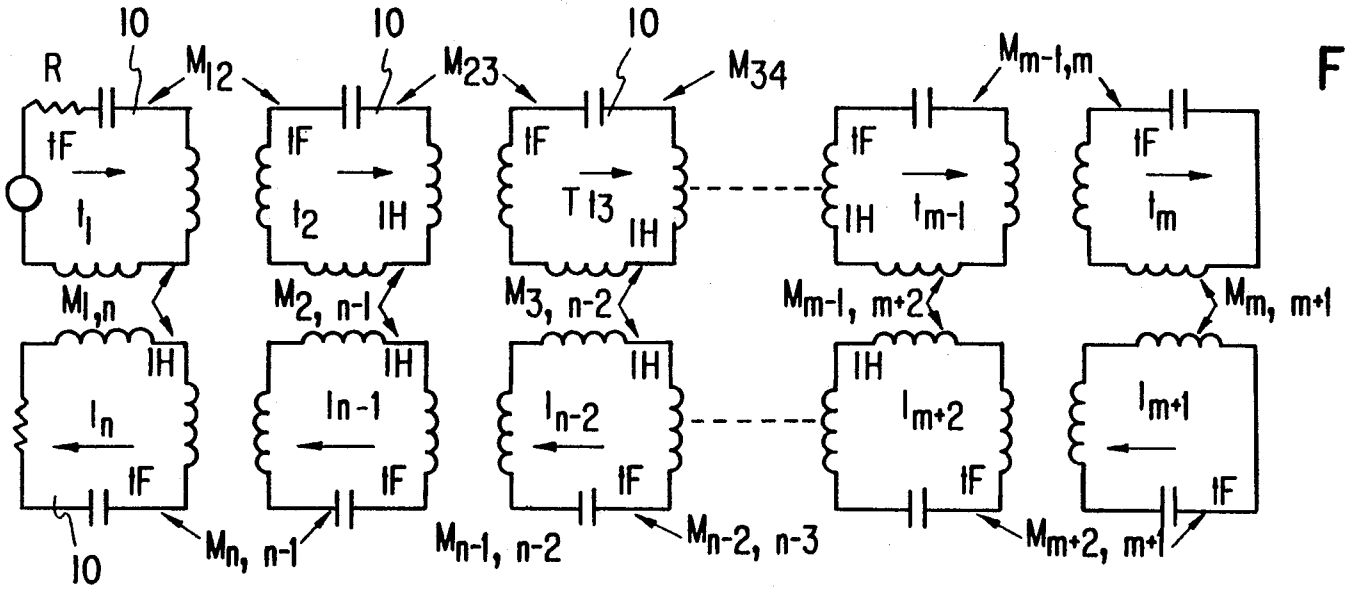
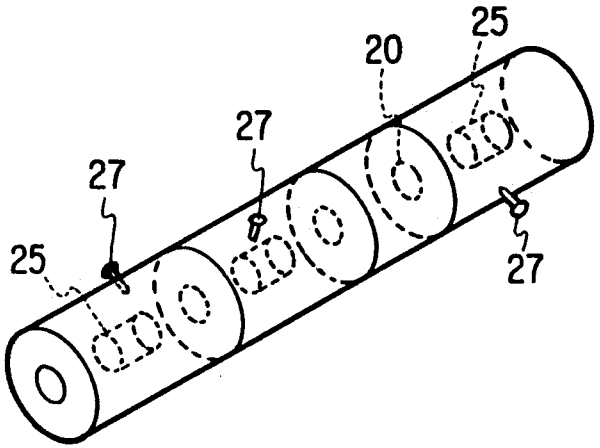
FIG. 2

FIG.4(a)
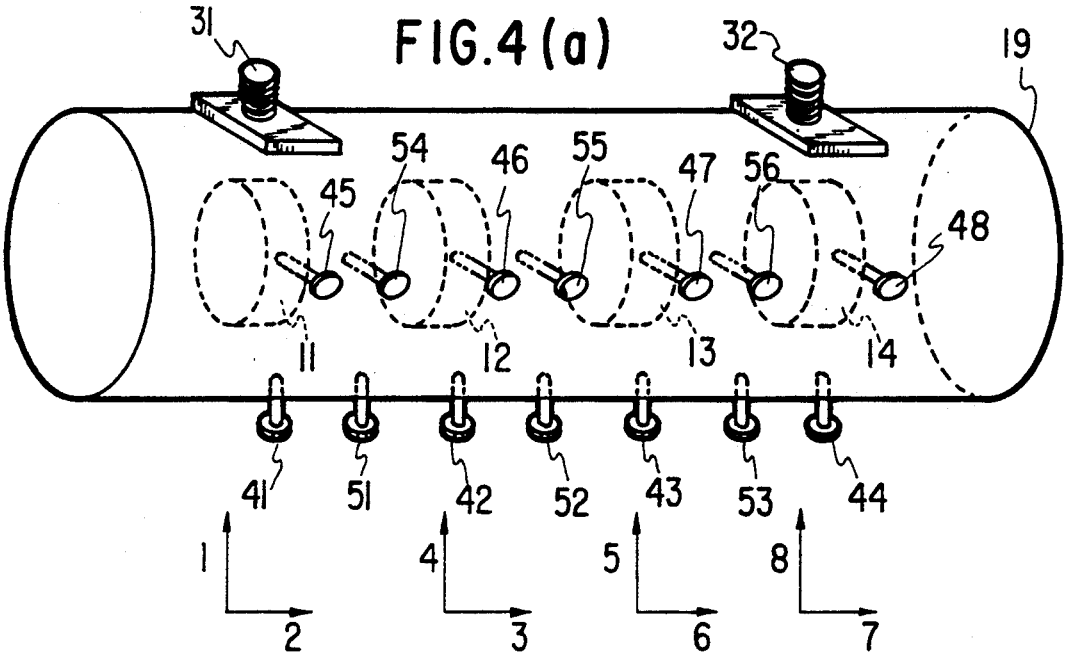
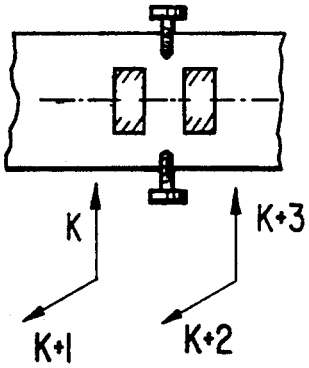
FIG.4(b)
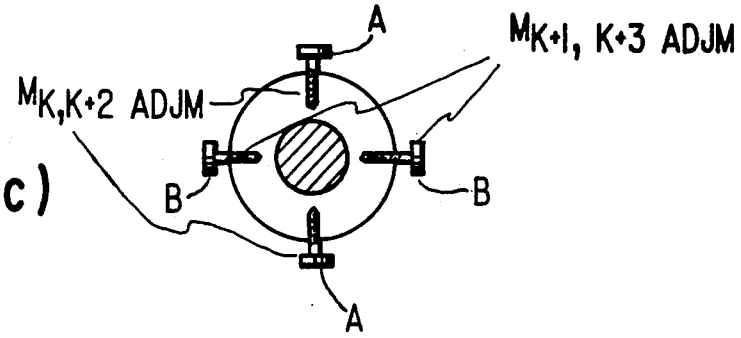
FIG.4(c)

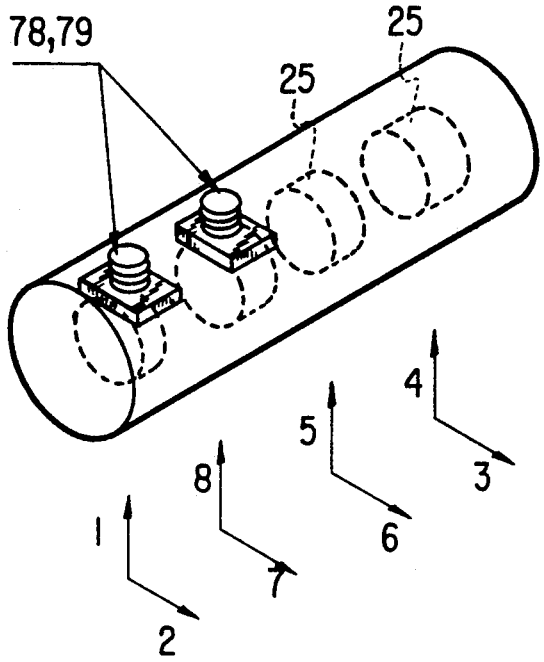
FIG.7
FIG.8
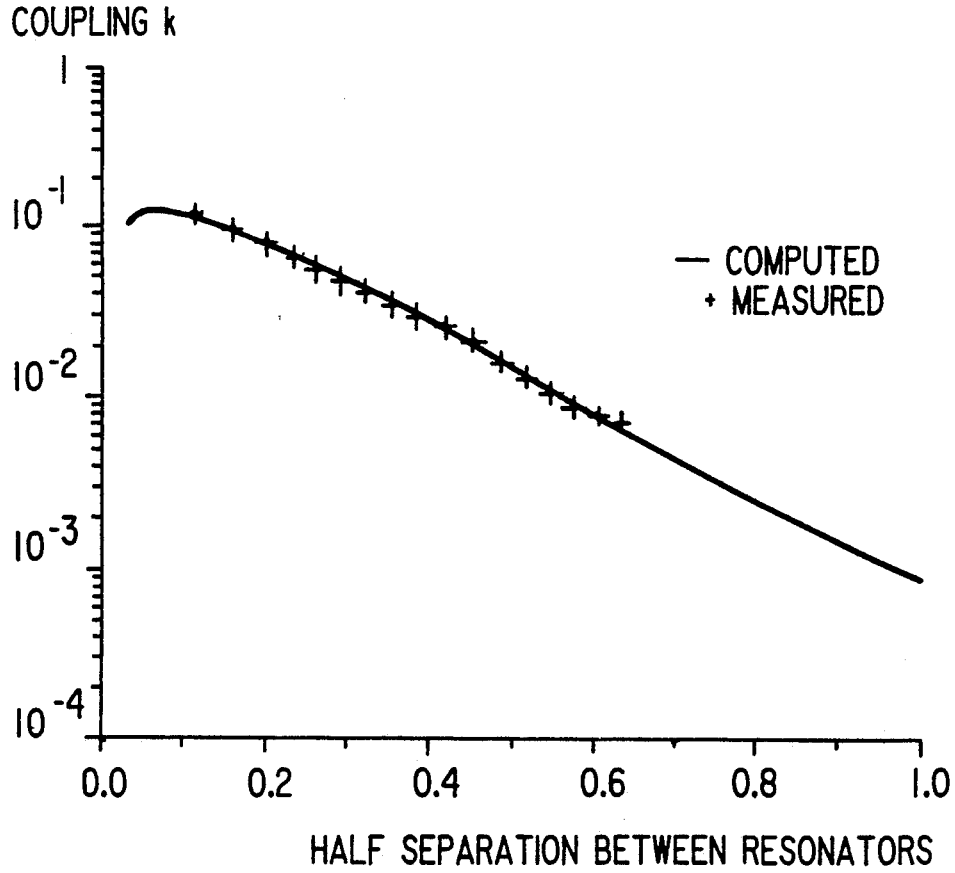

DUAL MODE DIELECTRIC RESONATOR FILTERS WITHOUT IRIS

This application is a continuation-in-part of copending Ser. No. 07/199,180 filed on May 26, 1988, now abandoned.

BACKGROUND OF THE INVENTION

1. Field of the Invention

The present invention is related to dual hybrid mode dielectric resonator band pass filters. More particularly, the present invention concerns filter realizations in tubular enclosures which are suitable for use in broadcast receivers, phased array radar applications and other applications requiring large quantity microwave narrow band pass filters.

2. Discussion of Background

The use of low pass, high pass and band pass filters in microwave systems is well known and is used to achieve results similar to the use of such filters at low frequencies to separate frequency components of a complex wave.

Early attempts at providing waveguide type of filters involve the utilization of the lumped-circuit method of cascading several filter sections together which was copied in the sense that microwave filter sections were cascaded with the spacing between the sections being any odd number of quarter wavelengths. The theory being that the greater the number of cavities used, the flatter the pass band and the skirts of the pass band become steeper. As a practical matter, however, the insertion loss in the pass band increases with the number of resonators.

Recent developments with respect to dual-mode band pass filters as in the article entitled "Narrow Band Pass Waveguide Filters" by Atia and Williams, IEEE Transactions on Microwave Theory and Techniques, Vol. MTT-20, pages 258–265, April 1974 and "Dual-Mode Canonical Waveguide Filters" by Williams and Atia, IEEE Transactions on Microwave Theory and Techniques, Vol. MTT-25, pages 1021–1025, December 1977, and U.S. Pat. No. 3,969,692, July 13, 1976, "Generalized Waveguide Band Pass Filters", and U.S. Pat. No. 4,060,779, Nov. 29, 1977, "Canonical Dual Mode Filters" possess significant performance advantages over the above discussed conventional waveguide realizations which are detailed for example in "Microwave Filters, Impedance Matching Networks and Coupling Structures" by Matthaei, Young and Jones, New York: McGraw-Hill, 1965. These advantages of the dual mode band pass filters are especially significant in applications where the mass and the volume are critical. Other dramatic reductions in the filter size and the mass are achieved by using dielectric loading of the cavities with high-dielectric, low-loss temperature stable materials as reflected in the article by Fiedziusko entitled "Dual-Mode Dielectric Resonator Loaded Cavity Filters", IEEE Transactions on Microwave Theory and Techniques, Vol. MTT-30, pages 1311–1316, September 1982.

Whether the filters are air-filled or dielectric-loaded dual-mode filters each of these type of structures in the prior art required that physically adjacent resonators be coupled to each other through iris slots or holes. These iris slots or holes required an extremely high degree of precision to provide the required accuracy for achievement of an exact filter response. Therefore, between each resonator, there was required a iris which had to be machined and silver plated which naturally led to major cost in producing to such extreme tolerances.

Therefore, in view of the high cost the utilization of these filters is restricted to applications where the performance, mass and size are extremely critical factors, as for example communication satellites. Normally their use was precluded in areas where cost is the major factor as where there are an extremely large number of filters to be used in, for example, phased arrays.

When filters such as hybrid dual mode dielectric resonators are configured, the most general band pass transfer function which is realizable utilizes a multiple coupled cavity structure which can be reduced to a canonical form containing the minimum number of coupling elements. FIG. 1 shows an equivalent circuit of a canonical form which consists of a number of identical resonant circuits 10 coupled in cascade by frequency invariant coupling elements $M_{i,\,i+1,\,i=1,2,\ldots m}$ having the same sign. Each resonant circuit 10 in one half is coupled to the corresponding circuit in the other half by means of a specified sign cross coupling element $M_{i,\,n-i,\,i=1,2,\ldots m}$.

When the dielectric loaded resonators excited in hybrid mode ($HEH_{11}$), are used in the canonical form, the result is shown in the FIG. 2. The Hybrid mode characteristics are discussed in Applicant's article entitled "New Results in Dielectric Loaded Resonators", IEEE Transactions on Microwave Theory and Techniques, Vol. MTT-34, No. 7, July 1986, pages 815–824. The realization of FIG. 2 is similar to the realization of a circular waveguide form excited in $TE_{111}$ modes described in the above-referred to article "Dual-Mode Canonical Waveguide Filters", 1977 and U.S. Pat. No. 4,060,779; (November, 1977). The cascade couplings of FIG. 1 are provided in FIG. 2 by the circular iris 20 separating each dielectric resonator 25. The coupling screws 27 are located at a 45° angle to the direction of the degenerate dual modes and provide cross couplings. The relative signs of any two cross couplings are determined by the relative directions of the corresponding coupling screws with the same sign being dictated by parallel screws and opposite signs being dictated by perpendicular screws. Although not shown, it is a feature of the dual mode structure, whether air-filled or dielectric, that there are two tuning screws associated with each resonator in order to adjust the resonant frequency of each set of orthogonal modes. This is discussed in the above-discussed April 1974 and December 1977 articles by Atia and Williams.

The realization of cascade couplings produced by the iris separation of the resonators in FIG. 2 presents the above-discussed difficulties concerning the manufacture of these iris elements and the extreme accuracy with which they must be manufactured. Thus, although dual mode dielectric resonator filters, which are extremely light and extremely space conservative, are available, from a practical standpoint the cost to manufacture prohibits their use in most large quantity microwave narrow band pass filter applications.

SUMMARY OF THE INVENTION

Accordingly, it is an object of the present invention to provide a realization of the most general form of multiple coupled cavity transfer functions in dual mode dielectric resonators without using an iris.

It is a further object of the present invention to provide a microwave band pass filter consisting of high dielectric constant ceramic cylindrical disks having input and output provided by coaxial probes and wherein adjustment and control of the frequency of the resonators is accomplished by tuning and coupling screws.

It is a further object of the present invention to provide a microwave band pass filter whereby the need for expensive machined parts requiring tight tolerances is eliminated in a configuration for dual-mode dielectric resonators in simple tubular enclosures.

It is a further object of the present invention to provide a microwave band pass filter which achieves lower mid-band insertion losses than comparable filters having irises by eliminating conduction currents on the metallic cavity ends.

It is a further object of the present invention to provide a canonical form microwave band pass filter having a general band pass transfer function which is realized by multiple coupled cavity structure and which contains a minimum number of coupling elements without the use of an iris wherein proper cascade coupling values between two adjacent resonators excited in the hybrid modes are obtained by adjusting the spacing between the resonators.

It is also an object of the present invention to provide a canonical dual-mode filter without coupling holes or irises in which the coupling between the input and output cavities is achieved by the orientation of a coupling screw which creates, by its orientation, two additional transmission zeros in the stop band of the filter which increases the filter's selectivity.

It is a further object of the present invention to maximize the out-of-band isolation achievable with dual-mode canonical band pass filter by utilizing an asymmetric coupling structure or by maximizing the number of realizable finite transmission zeros as is possible with longitudinal dual-mode filters.

It is a further object to realize the utilization of longitudinal dual-mode filters by providing a structure whereby unequal couplings between any two corresponding modes of adjacent dual-mode resonators is provided.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a schematic illustration of a canonical form of an equivalent filter circuit of n=2m coupled cavities;

FIG. 2 is a schematic perspective view of a realization of the canonical form of the filter of FIG. 1 using dielectric-loaded resonators excited in hybrid ($HEH_{11}$) modes with coupling holes/iris;

FIG. 4(*a*) is a schematic perspective view of a longitudinal dual mode dielectric resonator filter without iris according to another embodiment of the present invention, and FIG. 4(*b*) and 4(*c*) respectively show a side view and an end view of the coupling adjustment between two hybrid mode dielectric resonators;

FIG. 7 is a perspective view showing an alternate embodiment of the filter of the present invention in the form of a canonical nonsymmetric dual mode dielectric resonator filter without iris; and FIG. 8 is a graph showing the computed and measured coupling between two resonators for the hybrid $HEH_{11}$ mode.

DETAILED DESCRIPTION OF THE PREFERRED EMBODIMENTS

Figure 3:
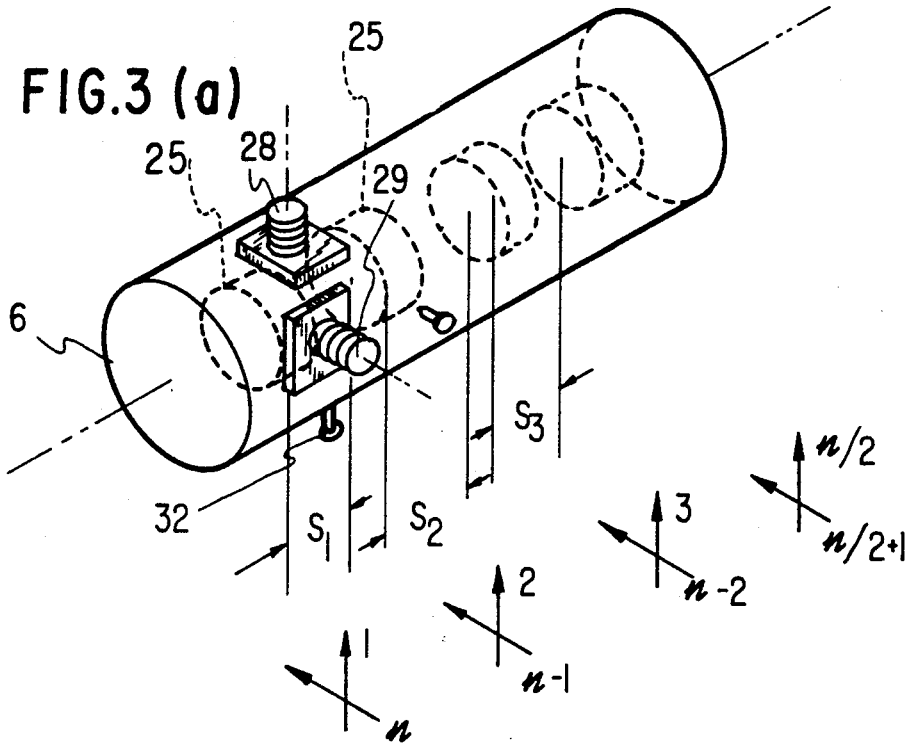
FIG. 3(*a*) is a perspective view of a canonical dual mode dielectric resonator filter without iris according to the present invention, and FIG. 3(*b*) is an end view of the filter of FIG. 3(*a*) additionally showing alternative orientations of coupling screw $M_{ln}$ with respect to the connectors (input/output ports)
Figure 3:
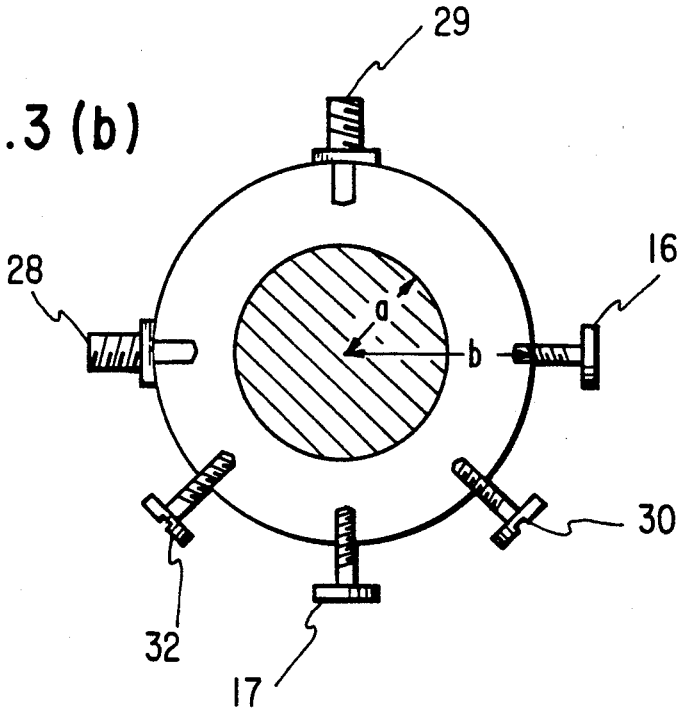

Referring now to the drawings, wherein like reference numerals designate identical or corresponding parts throughout the several views, and more particularly, to FIG. 3(*a*) thereof, there is shown a dual-mode dielectric resonator in tubular enclosure 6 which is a reduction of the most general band pass transfer function realizable by a multiple coupled cavity structure. The reduced system shown in FIG. 3*a* is a canonical form containing the minimum number of coupling elements which has no iris. The proper cascade coupling values between any two adjacent dual mode resonators 25 excited in the hybrid modes is obtained by adjusting the spacing S ($S_1$, $S_2$, $S_3$) between the dielectric ceramic disc resonators 25. The input and output ports shown by the connectors 28 and 29 are located in the same physical cavity and can be realized by having the coaxial probes couple the radial electric fields of each of the two orthogonal dual modes of the resonators as shown in FIG. 3*a* and in FIG. 3*b*. The amount of coupling (or external Q) of the two orthogonal modes is controlled by the depth of penetration and by the thickness (diameter) of the probe as shown in FIG. 3*b* with the probes being shown attached to the connectors 28 and 29 in an orthogonal position. The maximum isolation achievable between the input and output ports is in this case only limited by the ability to maintain the probes mechanically at right angles with respect to each other and partially by spurious mode couplings. The maximum isolation has been shown to have a top limit of approximately 30 dB, which can be achieved by the two orthogonal probe coupling mechanism.

As discussed previously, the center frequency of a filter of the prior art which use an iris as in FIGURE 2, is to a first order determined by the resonant frequency of the dielectric resonators and to a lesser extent by the metallic boundary of the cylindrical tube and the end planes containing the iris 20 of FIG. 2. If each iris is completely removed, as is accomplished in the FIG. 3*a* embodiment of the present invention, the resonant frequencies of the dielectric resonators will be slightly changed, and the couplings between the two corresponding pairs of hybrid modes existing in two adjacent resonators will be equal because of the circular symmetry. The value of these couplings are determined by the aforementioned spacing S1, S2, S3 between the resonators. The configuration whereby the input and output ports are derived from two orthogonal modes in the same resonator provides the realization of the symmetrical canonical form of FIG. 3*a*.

The screws 30 and 32 shown in the FIG. 3*a* and more particularly in the FIG. 3*b*, provide two embodiments for regulating the coupling between the input and output cavities 28 and 29. The orientation "A" shown by screw 30 provides two additional transmission zeros in the stop band of the filter. These additional zeros as well as of course any other zeros help to improve the selectivity of the filter. On the other hand, the orientation "B" does not introduce these real frequency transmission zeros, and the filter formed by the screw 32 becomes less selective than the orientation shown by screw 30. The orientation of the screw 30, called the orientation "A", involves a location which is symmetrical at a 45° orientation with respect to the projections of the input and output coaxial probes 28 and 29 through the tubular enclosure. Although not shown in FIG. 3(*a*), there are two tuning screws associated with each resonator, as is known in the art of dual mode resonators, with each screw adjusting the resonant frequency of one mode. FIG. 3(*b*) illustrates a set of tuning screws 16, 17 for the first resonator.

Figure 5:
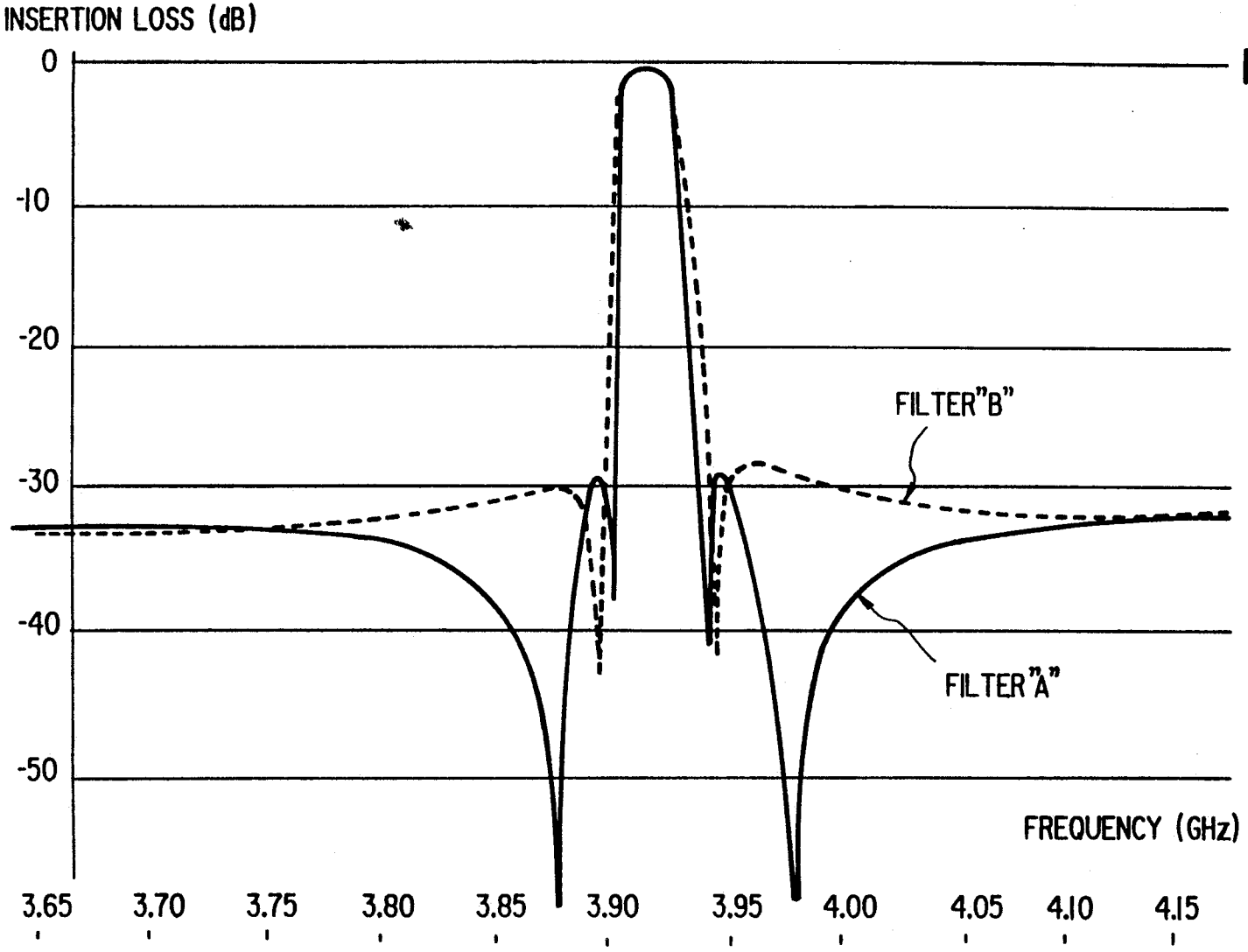
FIG. 5 is a graph showing the measured insertion loss response of two separate 4-pole filters in accordance with the FIG. 3 embodiment.

FIG. 5 illustrates the differences between the embodiment with a filter "B" formed by a coupling screw 32 when compared with a filter "A" formed by an orientation of a coupling screw 30. It can be seen quite clearly by way of examination of the insertion loss response as indicated in FIG. 5 that the filter "A" using the screw 30 has two additional zeros to provide an improved selectivity for the filter.

The position of the coupling screw 30 or 32 for the first resonator determines that the second resonator have a coupling screw which is 90° from the location of the first resonator coupling screw as is shown in the FIG. 2 coupling screw relationship between the consecutive resonators 25.

It should also be noted that instead of the configuration for the connectors 28 and 29 shown in FIG. 3*a* and 4*a*, a single coaxial probe port can be used with the other probe port being a dipole, a loop or waveguide slot, which couples to the magnetic field of the mode near the end wall of the resonator. Such a utilization of a dipole or a loop in conjunction with a coaxial probe port or a slot in conjunction with a waveguide port, can provide better isolation between the input and output ports than the two orthogonal probes of FIGS. 3*a* and 3*b* because it is less susceptible to spurious couplings. However, the use of a dipole or a loop is more difficult to realize than using two simple coaxial probes and is also more sensitive to dimensional tolerances.

The parameters which are required for the design of a filter configured of the dual-hybrid-mode dielectric resonators in the cylindrical tube as shown in FIGS. 3*a* and 3*b*, include the resonant frequency of the resonators in the tube, the coupling between two adjacent resonator, and the external Q of the probe. The theoretical calculation of the resonant frequency can be performed using previous methods, as for example those described in "New Results in Dielectric Loaded Resonators" IEEE Transactions Microwave Theory Techniques Vol. MTT-34, pages 815–824, July 1986 by Zaki and Chen. The selection of the optimum resonator dimensions which result in the widest spurious-free stop band can be made based on mode charts of the resonators as detailed in the above referenced Zaki and Chen article. The variations of the ratio between the closest spurious modes to the desired mode of a resonator in an infinitely long waveguide with a diameter to length ratio shows that when both the desired mode frequency and the ratio of the diameter of the tube to the diameter of the dielectric were held constant, then the optimum ratio of the diameter of the dielectric to the length of the dielectric for the mode would be approximately 3.5, which results in a spurious-free region approximately 30% of the resonant frequency. From these techniques, the optimum diameter of the dielectric resonator is approximated by the formula $$2a=(c/f_0)(2.24/\epsilon_r)^{\frac{1}{2}}$$

where c is the speed of light and $f_0$ equals the desired mode frequency.

Coupling calculations between hybrid modes are described in the article entitled "Coupling of Non-Axially-Symmetric Hybrid Modes in Dielectric Resonators" IEEE Transactions Microwave Theory Techniques pages 1136–1142 December 1987. The computed and experimentally measured data show the variation of the coupling coefficient between two resonators as a function of separation as graphically illustrated in FIG. 8.

As indicated previously, the maximum out-of-band isolation achievable with the dual-mode canonical filter realizations described in conjunction with the FIGS. 3*a* and 3*b* is limited due to the incidental coupling between the input and output ports 28 and 29 which always exist in the same cavity. Although it may be possible to improve this isolation by using a dipole, loop, or waveguide slot in one of the ports as previously discussed, such improvement involves complicating the structure. In order to achieve anywhere close to the theoretically possible isolation in the out-of-band insertion loss of the filters, the input and output ports must be located in two different physical resonators. Although this is not possible with the symmetrical canonical form described in conjunction with the embodiment of FIG. 3, there are realizations which achieve the same response with asymmetric coupling structure as shown in FIG. 7 or achieve the required isolation without the maximum number of realizable finite transmission zeros (e.g. longitudinal dual-mode filters).

In order to realize such type of filters, a way of providing unequal coupling between any two corresponding modes of adjacent dual-mode resonators is required. Because of the structure described with respect to the canonical configuration of FIG. 3, the couplings are always equal due to circular symmetry, a modification to the type of structure of FIG. 3 is required in order to achieve this unequal coupling and therefore provide desirable realizations either having asymmetric coupling or required isolation without the maximum number of realizable finite transmission zeros.

The coupling configuration shown in FIG. 4*b* consist of two dielectric resonators separated by a distance S. Screws for coupling adjustments are placed midway between the resonators parallel to the maximum of the radial electric fields of the two hybrid modes. By changing the penetration of these screws, the coupling between the two pairs of hybrid modes can be changed independently of each other. Thus, the coupling $M_{k,k+3}$ between the two modes (k,k+3) can be changed by adjusting the penetration of screws A—A as shown in FIG. 4c. This change of the screws A—A is made without effecting coupling between the modes (k+1, k+2). In a similar manner the coupling $M_{k+1,k+2}$ between the two modes (k+1,k+2) can be adjusted by changing the penetration of the screws B—B without effecting the coupling $M_{k,k+3}$. Thus unequal coupling between each of the two pairs of hybrid modes can be realized without the need for an iris. It is further noted that these couplings can be simply and independently controlled by means of the coupling screws and it is important to note that the increase in the depth of penetration of the screws increases the corresponding coupling between the mode pair. Thus, in the design of filters, the spacing S from FIG. 4b between the two resonators is chosen to correspond to a coupling value which is slightly less than the minimum required of the two couplings $M_{k,k+3}$ and $M_{k+1,k+2}$. The screws A—A and B—B can then be used to adjust the coupling to achieve precise desired values for these unequal couplings.

A filter which employs the principles of FIGS. 4 and 4c is shown in FIG. 4a which illustrates an eight-pole dual-mode longitudinal filter which can achieve two pairs of finite transmission zeros.

The embodiment of FIG. 4a which illustrates the longitudinal dual-mode filter consists of high dielectric constant ceramic cylindrical disks 11–14 placed inside a metallic tubular enclosure 19 with the disk resonators 11–14 being coaxial and supported by foam supports, inside the tube. Coaxial connectors 31 and 32 with their center conductors extend inside the enclosure 19 and these connectors 31 and 32 serve as input and output ports of the filter. The tuning screws 41–44 are provided to adjust the resonant frequencies of one set of resonant modes, while the other set of tuning screws 45–48 are provided to adjust the resonant frequencies of the orthogonal set of resonant modes of the dielectric resonators 11–14. The screws 51–53 which are placed midway between adjacent resonators serve to control the coupling of energy between the resonant modes in one direction, while the set of screws 54–56 serve the same function for the orthogonal set of resonant modes.

In order to design the filter of FIG. 4a, the dimensions of the dielectric resonators are determined so that the resonant frequency is the $HEH_{11}$ mode which corresponds to the desired center frequency of the filter with the other spurious modes separated as far as possible, as discussed previously. The distances between each of the disk resonators 11–14 are computed so as to yield couplings which are slightly less than a minimum ($M_{14}$, $M_{23}$), the minimum ($M_{36}$, $M_{45}$) and the minimum ($M_{58}$, $M_{67}$) respectively. The rest of the coupling matrix elements, i.e. $M_{12}$, $M_{34}$, $M_{56}$ and $M_{78}$ are realized by means of 45° coupling screws approximately located in the planes bisecting the lengths of the corresponding resonators. These coupling screws are not shown in FIG. 4(a) for the sake of simplicity but are similar to those coupling screws in the canonical embodiment of FIG. 3. The subscripts for the couplings are determined in accordance with the formula for cross coupling of FIG. 4b and the respective labeling in FIG. 4a concerning each of the eight pole configurations.

The eight pole filter which is shown in FIG. 7 can realize the optimum transfer function available by the symmetric canonical form of FIG. 3. However, the advantage of the form of FIG. 7 is that this realization allows the input and output ports to be located in two different resonators thereby eliminating the limitation imposed on the maximum out-of-band isolation which exist in the canonical form. The synthesis procedure for developing this type of filter is similar to the procedure with regard to the dual-mode longitudinal filter. The figure has the resonant modes labeled with their coupling and the connectors 78 and 79 associated with two different resonators 25.

As a validation of the above embodiments, three experimental four-pole elliptical function filters were designed, constructed and tested in accordance with the parameters of Table I.

TABLE I

| Parameter | Filter Parameters: Canonical Filter | Longitudinal Filter |
|---|---|---|
| Center Frequency (GHz) | 3.9145 | 3.920 |
| Bandwidth (MHz) | 21.0 | 47.0 |
| Normalized input impedance $R_1$ | 1.300 | 1.150 |
| Normalized output impedance $R_2$ | 1.300 | 1.150 |
| Coupling Matrix M | 0 .98 0 −.21 / .98 0 .84 0 / 0 .84 0 .98 / −.21 0 .98 0 | 0. .86 0 −0.26 / .86 0. .80 0 / 0 .80 .0 .86 / −0.26 0 .86 0 |

Two of the three experimental filters were of the canonical dual-mode type having a $M_{14}$ for coupling screw located in accordance with the orientation "A" or orientation "B" as previously discussed with respect to the FIGS. 3a and 3b. The distance S between adjacent resonators determines the couplings $M_{12}$ and $M_{34}$ (which are equal, as indicated by the coupling matrix M of Table I). The couplings $M_{23}$ are realized by screws located at 90° angles from the respective $M_{14}$ screws. The measured insertion loss responses of the two filters either A or B over a wide frequency band are illustrated at FIG. 5, as discussed-previously.

The Coupling Matrix associated with the Canonical filter uses the convention established in FIG. 3(a) wherein the Matrix for the Longitudinal filter use the convention shown in FIG. 4(a).

Figure 6:
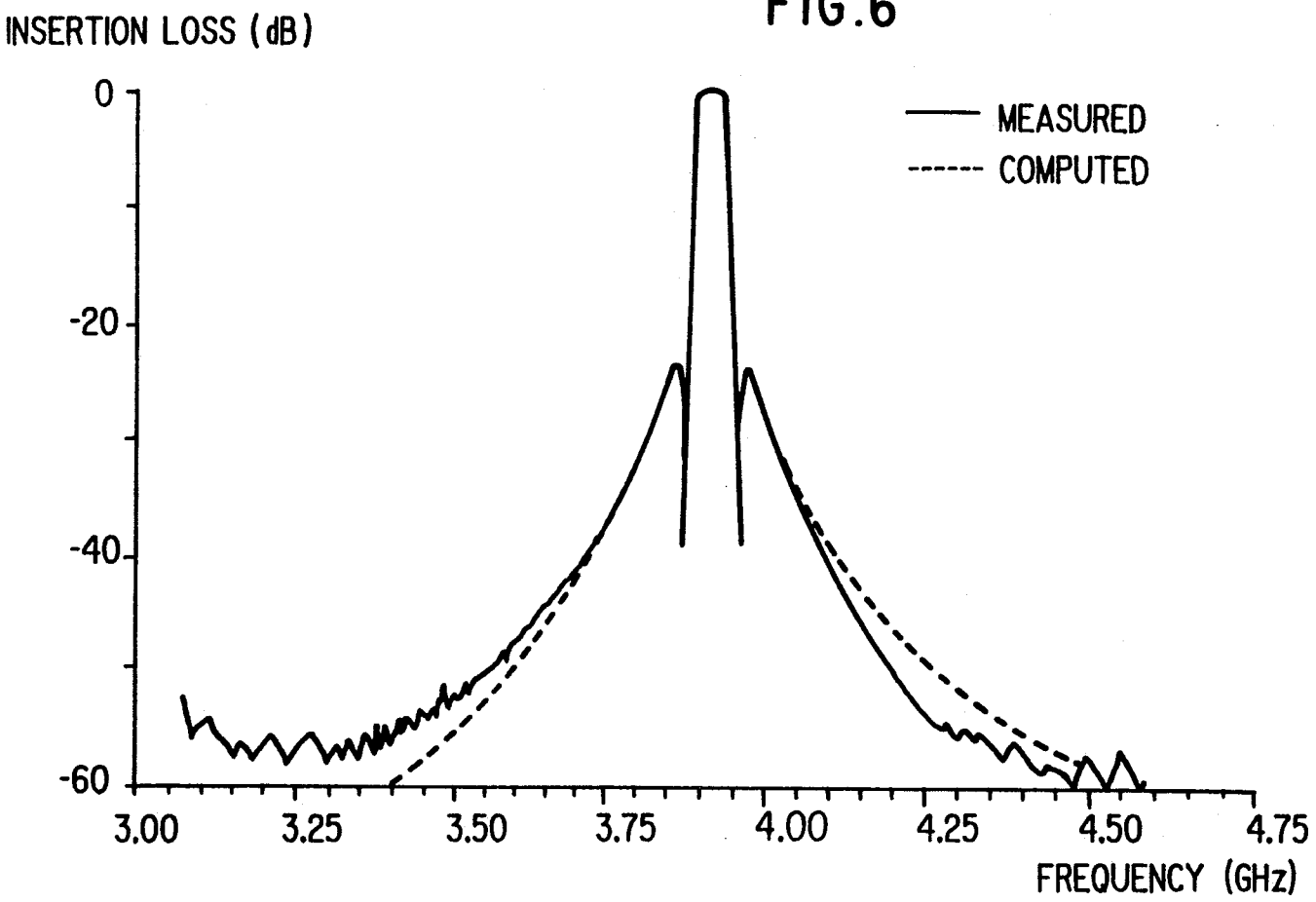
FIG. 6 is a graph showing the measured and computed insertion loss response of the longitudinal filter of FIG. 4(*a*)–(*c*)

The third filter which was designed has input and output ports in separate resonators (i.e. a longitudinal type). The computed and the measured insertion loss response of the longitudinal filter are shown in FIG. 6 wherein the improvement in the out-of-band isolation is due to location of the input and output ports at two different resonators.

Thus, whether implemented in the form of the longitudinal dual mode of FIG. 4a or the canonical symmetric form of FIG. 3a or the asymmetric canonical form of FIG. 7, there is disclosed a microwave band pass filter consisting of high dielectric constant ceramic cylindrical disks placed inside a metallic tubular enclosure which provides a realizable form of the most general form of multiple coupled cavity transfer functions without using an iris in order to drastically reduce the cost of the production of the filters and to open up these type of dual mode dielectric resonators for use in microwave filter applications for direct broadcast receivers, phased array radar applications and any of a number of other large quantity microwave narrow band pass filter applications which require high quality, miniaturization and low cost.

Although the above description provides realizations of dual mode dielectric resonator filters having no iris, the principle advantage of using no iris mainly concerns the elimination of parts which require tight tolerances. However, when very small couplings are needed in certain realizations such as in applications where mass and volume are critical, such as satellite transponders, the length of the filters may become excessive due to the increased resonators spacings which is required to produce small couplings. In this instance, the inclusion of one iris can by an advantage at the locations where the small coupling is needed so that the overall length of the filters kept at a reasonable value. Considering the above embodiment, a compromise can be reached with respect to the offsetting purposes of eliminating of parts requiring tight tolerances and the desire for smaller filters by a realization wherein a single iris utilized.

Stated another way, the advantages of the present invention can be obtained by eliminating all but one of the irises. The single iris contemplated by this embodiment is used to couple two symmetrical halves of the dual mode dielectric resonator filter in order to reduce its length.

In order to comprehend the essence of such an embodiment, an even mode coupling matrix of an 8-pole symmetric filter is considered wherein $$M_e = \begin{bmatrix} 0. & 0.8203 & 0. & -0.2749 \\ 0.8203 & 0. & 0.7674 & 0. \\ 0. & 0.7674 & -0.0075 & 0.4828 \\ -0.2749 & 0 & 0.4828 & 0.5369 \end{bmatrix}$$

Figure 10:
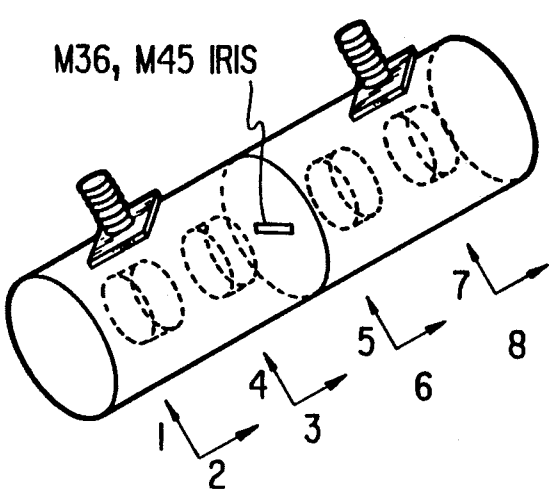
FIG. 10 illustrates a further embodiment of an improvement of the present invention utilizing a single iris in place of the coupling screws of FIG. 9 for the 8-pole .R. filter.
Figure 9:
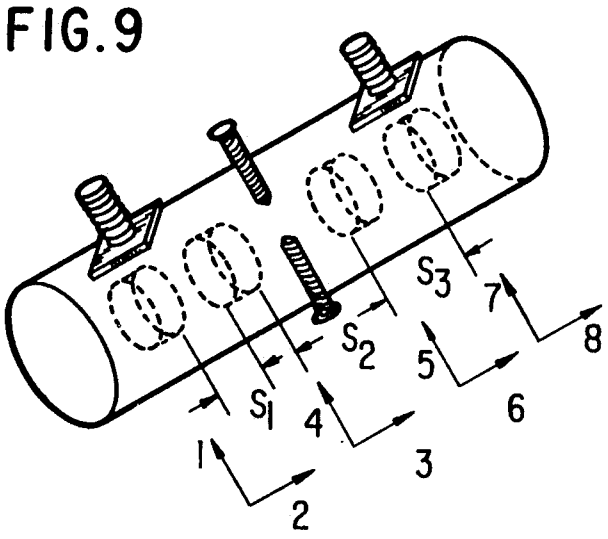
FIG. 9 illustrates a particular embodiment which particularly addresses a coupling screw between the third and fourth resonators.

To realize this filter using dual mode dielectric resonators without iris configuration, the coupling pair $M_{36}$ $(=M_{e33})=-0.0075$ and $M_{45}$ $(=M_{e44})=0.5369$ must be achieved. The appropriate spacing between resonators is chosen to correspond to $M_{36}$, while coupling screws must be provided to achieve $M_{45}$, as shown in FIG. 9. Because of the extremely small value of $M_{36}$, the required spacing $S_{36}$ will be very large, yielding an unrealistically long filter. For example, for a filter bandwidth of 20 MHz at C-Band, this spacing must be about 5.6 inches, while the spacing $S_{14}$ required to realize $M_{14}$ is a more reasonable 0.85 inches. To alleviate this problem, the realization shown in FIG. 10 is used. The iris is introduced and its dimensions are chosen to provide the coupling $M_{45}$ through its length, and $M_{36}$ through its width. In this case the spacing between resonators (3,4) and (5,6) can be maintained to a much more practical value (about 0.4 inches).

Figure 11:
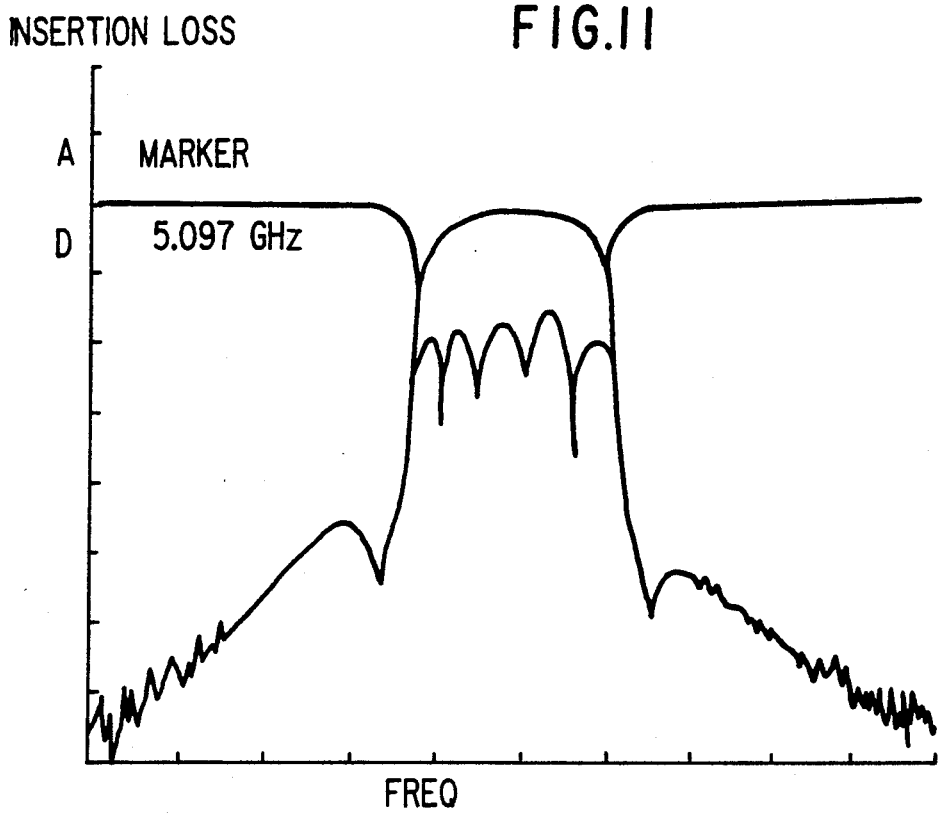
FIG. 11 is a graph of measured insertion loss and return loss for the embodiment of FIG. 10.
Figure 12:
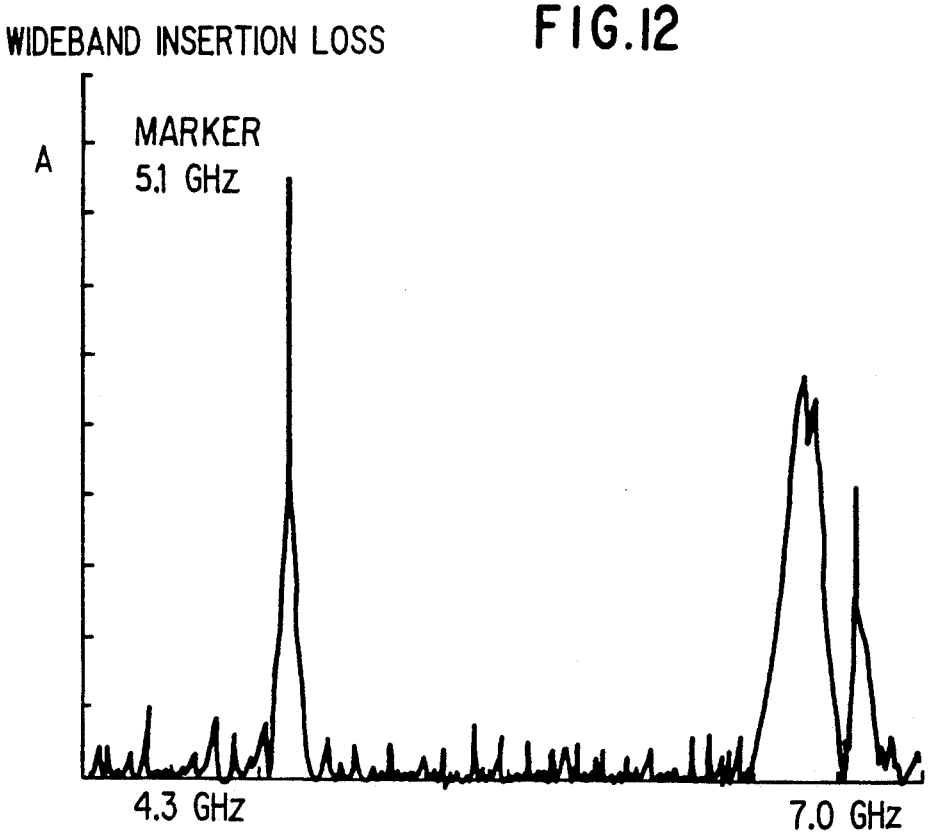
FIG. 12 is a graph of the wide-band insertion loss up to 7 GHz of the embodiment of FIG. 10.

An 8-pole D.R. filter having the coupling matrix given in (1), centered at 5.097 GHz and of 16 MHz bandwidth was designed and realized with one iris as described above. Measured insertion loss and return loss are shown in FIG. 11. The wideband insertion loss up to 7 GHz is shown in FIG. 12. The closest spurious response of this filter occurs at 6.63 GHz, and corresponds to the $HEH_{12}$ [5] mode. The measured results agree closely wit h the calculated response of the filter.

The introduction of a single iris allows the realization of a reasonable length D.R. filter, while maintaining most of the advantages of D.R. filters without iris. This concept can always be advantageously used whenever the couplings of two adjacent dual mode resonators have vastly different magnitudes.

Obviously, numerous modifications and variations of the present invention are possible in light of the above teachings. It is therefore to be understood that within the scope of the appended claims, the invention may be practiced otherwide than as specifically described herein.

What is claimed as new and desired to be secured by Letters Patent of the United States is:

1. A dual hybrid mode dielectric resonator band pass filter, comprising:

a tubular enclosure including a first plurality of n, n is a whole number, cascade couple ceramic dielectric-loaded disk resonators, wherein each of said resonators is spaced from each other and coaxially supported in said tubular enclosure;

means for exciting said resonators in said tubular enclosure so as to provide dual hybrid modes, said means for exciting including first and second probes fixed to and penetrated into said enclosure for providing input and output ports, coupling means for providing cross coupling of two orthogonal modes of each resonator, wherein said probes coupled the radial electric fields of said two orthogonal modes of said resonators and wherein the depth of penetration into said enclosure and the thickness of said probe is proportional to the amount of coupling of said dual-modes; and wherein the cascade coupling between the n/2 and the (n+1)/2 th resonator of said first plurality n resonators is determined by an iris placed between said n/2 and (n+1)/2 th resonator, and wherein the cascade coupling between a second plurality of adjacent resonators is determined by the spacing between any two resonators of said second plurality and wherein said second plurality of adjacent resonators is defined as adjacent ones of the 1st to n/2th as well as adjacent ones of the (n+1)/2 th to n th ones of said first plurality n of adjacent resonators.

2. The filter according to claim 1, wherein:

said first probe and said second probe are each associated with different ones of said first plurality of disk resonators; and said coupling means includes means for controlling the coupling of energy between each of the resonator modes in both orthogonal directions wherein said means for coupling includes a first series of screw means each placed midway between adjacent ones of said second plurality of resonators in order to control the coupling of energy between the resonant modes in one direction and a second series of screw means for each of said screw means of said second series of screw means as placed midway between the adjacent ones of said second plurality of resonators in order to control the coupling of energy between the orthogonal set of resonant modes.

3. The filter according to claim 2, wherein each of said first series and said second series of screw means includes a set of two screws positioned opposite each other on said tubular enclosure.

4. A dual hybrid mode dielectric resonator band pass filter, comprising:

a tubular enclosure including a plurality of cascade coupled ceramic dielectric-loaded disk resonators, wherein each of said resonators is spaced from each other and coaxially supported in said tubular enclosure;

means for exciting said resonators in said tubular enclosure so as to provide dual hybrid modes, said means for exciting including first and second probes fixed to and penetrating into said enclosure for providing input and output ports, coupling means for providing cross coupling of two orthogonal modes of each resonator, wherein said probes couple the radial electric fields of said two orthogonal modes of said resonators and wherein the depth of penetration into said enclosure and the thickness of said probe is proportional to the amount of coupling of said dual modes; and wherein the cascade coupling of said cascade coupled ceramic resonators between any two resonators is determined by the spacing between said any two disk resonators.

5. The filter according to claim 4, wherein said first and second probes are positioned 90° from each other on said enclosure and wherein both said probes are located on the radial projection of one of said disk resonators.

6. The filter according to claim 5, wherein said coupling means comprises:

a coupling screw positioned on the radial extension of said one of said disks at a symmetric 45° angle with respect to the projections of the penetration through said enclosure of each of said first and second probes.

7. The filter according to claim 4, wherein said coupling means comprises:

coupling screw means including a coupling screw associated with each of said resonators and positioned on said tubular enclosure in such a manner that a coupling screw associated with any one of said resonators is positioned on said tubular enclosure 90° away from the coupling screw associated with an adjacent resonator.

8. The filter according to claim 7, further comprising:

a first and second set of tuning screws wherein one of said first set and one of said second set of tuning screws is associated with each of said resonators in order to adjust both resonator modes of each of said resonators.

9. The filter according to claim 4, wherein:

said first probe and said second probe are each associated with different ones of said plurality of disk resonators; and said coupling means includes means for controlling the coupling of energy between each of the resonant modes in both orthogonal directions, wherein said means for coupling includes first series of screw means each placed midway between adjacent resonators in order to control the coupling of energy between the resonant modes in one direction and a second series of screw means wherein each of said screw means of said second series of screw means is placed midway between the adjacent resonators in order to control the coupling of energy between the orthogonal set of the resonant modes.

10. The filter according to claim 9, wherein each of said first series and said second series of screw means includes a set of two screws positioned opposite each other on said tubular enclosure.

11. The filter according to claim 4 further comprising:

means for providing unequal couplings between any two corresponding modes of adjacent dual-mode resonators.

12. A microwave band pass filter comprising:

a plurality of dielectric ceramic disks resonators coaxially placed in a cylindrical metallic tube;

first and second coaxial connectors having center conductors extending inside of said metallic tube wherein said coaxial connectors serve as input and output ports of said filter;

a first set of tuning screws provided to adjust the resonant frequency of one set of resonant modes;

a second set of tuning screws provided to adjust the resonant frequencies of an orthogonal set of resonant modes of said dielectric resonators;

a third set of screws placed midway between adjacent resonators in order to couple the energy between the resonant modes in one direction;

a fourth set of screws placed midway between adjacent resonators for controlling the coupling of energy between the resonant modes in the orthogonal set of resonant modes; and wherein said input and output ports are associated with different ones of said resonators.

* * * * *